US006931773B2

(12) United States Patent
Bihr

(10) Patent No.: US 6,931,773 B2
(45) Date of Patent: Aug. 23, 2005

(54) DISPLAY MEDIUM INTENDED TO BE INSTALLED IN A SCROLLABLE DEVICE

(75) Inventor: Eric Bihr, Meys (FR)

(73) Assignee: Prismaflex International, Haute Rivoire (FR)

( * ) Notice: Subject to any disclaimer, the term of this patent is extended or adjusted under 35 U.S.C. 154(b) by 1 day.

(21) Appl. No.: 10/467,360

(22) PCT Filed: Jan. 24, 2002

(86) PCT No.: PCT/FR02/00294

§ 371 (c)(1),
(2), (4) Date: Aug. 6, 2003

(87) PCT Pub. No.: WO02/065436

PCT Pub. Date: Aug. 22, 2002

(65) Prior Publication Data

US 2004/0064987 A1 Apr. 8, 2004

(30) Foreign Application Priority Data

Feb. 12, 2001 (FR) ..... 01 01851

(51) Int. Cl.[7] ..... G09F 11/18
(52) U.S. Cl. ..... 40/518; 40/514; 40/524
(58) Field of Search ..... 40/518, 514, 524; 198/837, 840, 842, 844.2

(56) References Cited

U.S. PATENT DOCUMENTS 4,084,687 A * 4/1978 Lapeyre ..... 198/844.2
4,894,888 A 1/1990 Bassouls
5,246,100 A * 9/1993 Stone et al. ..... 198/844.2
5,549,193 A * 8/1996 Schlueter, Jr. et al. ... 198/844.2
5,606,814 A * 3/1997 Szywalla et al. ..... 40/518
5,809,677 A * 9/1998 Wamser et al. ..... 40/518
5,822,899 A * 10/1998 Yonenaga ..... 40/524
5,979,093 A * 11/1999 Harruff et al. ..... 40/518
6,345,925 B1 * 2/2002 Coleman ..... 198/844.2
6,564,487 B1 5/2003 Bihr et al.
2002/0148707 A1 * 10/2002 Tarnawskyj et al. ..... 198/844.2
2002/0170806 A1 * 11/2002 Engle et al. ..... 198/844.2

FOREIGN PATENT DOCUMENTS

| | | |
|---|---|---|
| DE | 296 20 654 | 4/1997 |
| EP | 0 294 301 | 12/1988 |
| WO | 00/67243 | 11/2000 |

* cited by examiner

*Primary Examiner*—Gary C. Hoge
(74) *Attorney, Agent, or Firm*—Burr & Brown

(57) ABSTRACT

The invention relates to a display medium (1) intended to be installed in a scrollable device, the edges of which can be guided laterally inside the scrollable device. The inventive medium includes several adjacent sections (2, 3, 4) which are reversibly interconnected by means of the opposing horizontal edges thereof (10 13) including a lateral rod (7, 17, 27, 8, 18,38) located on each of the lateral edges extending continuously over each of the adjacent sections.

11 Claims, 4 Drawing Sheets

DISPLAY MEDIUM INTENDED TO BE INSTALLED IN A SCROLLABLE DEVICE

FIELD OF THE INVENTION

The invention relates to the display industry and more especially to the animated display sector where the display works by scrolling a printed canvas. It relates more especially to the structure of a display medium including several independent sections each bearing information to be displayed.

BACKGROUND OF THE INVENTION

In general, dynamic display devices operate by scrolling a display medium on which at least two, and more generally three, different notices have been printed. This canvas is wound in one direction then the other, and is regularly immobilized so that the printed notice is displayed correctly when viewed from the outside.

In a first family of scrollable devices, the display medium consists of a canvas onto which various paper notices are bonded. This canvas is wound onto motorized rollers, thus causing the paper notices to be wound up. It will be understood that this first solution may cause wrinkling when the canvas is wound, and these wrinkles may in turn cause the system to jam and therefore interrupt the correct displaying.

An improvement to this type of device was described by the applicant in document WO 00/67243. The display device described in that document comprises rollers onto which and from which a canvas bearing printed information is wound. To ensure optimum winding, the information-bearing canvas is kept under transverse tension as it is unwound. This maintaining of transverse tension also keeps the notice nice and flat, giving it a good appearance.

In order to maintain transverse tension in this way, the information-bearing canvas has lateral edges equipped with a rod able to slide in sideways that are fixed with respect to the scrolling device.

The display medium used may for example be a film of slightly extensible plastic that has been printed. More specifically, several successive notices are printed one after the other onto this canvas.

In practice, the scrollable devices are fed with information-bearing canvases according to the lengths of the display campaigns. Now, for certain products and certain advertisers, it may be that the periods are not the same for the various notices present on the same canvas. Hitherto it has been necessary to replace the entirety of a canvas even if just one of the notices needs to be replaced. That then entails a further operation of printing the notices which are not replaced but carried forward over successive periods. This is necessary in particular in order to maintain a one-piece structure as regards the lateral edges, which need to be continuous in order to slide correctly in the sideways that laterally guide and maintain transverse tension.

It will be appreciated that these printing operations are unnecessary because they consume quantities of canvas and printing resources in order to produce notices that have already been printed.

The problem that the invention sets out to solve is that of making it possible to optimize successive display campaigns by customizing the various notices while at the same time remaining compatible with installation in devices that maintain transverse tension, particularly through the use of lateral rods.

SUMMARY OF THE INVENTION

The invention therefore relates to a display medium intended to be installed in a scrollable device, and the edges of which can be guided laterally inside such a scrollable device.

According to the invention, this display medium is characterized in that it is made up of several adjacent sections joined together reversibly via their facing horizontal edges.

Furthermore, this display medium comprises a lateral rod situated on each of these lateral edges, this rod running continuously along all the adjacent sections.

In other words, the invention consists in detachably combining various independent sections on which separate notices have been printed, using a continuous rod present on each of the edges of the entity consisting of the associated sections. In that way, it is possible to modify the various areas displayed by replacing just the corresponding sections, and to do so with full freedom in the makeup of the complete canvas.

In other words, when, within the context of a display campaign, it is necessary to replace just one of the three notices for example, all that is required is for the corresponding section to be changed and the two sections whose display period has not yet expired to be kept.

Several architectures can be employed in order to produce the display medium according to the invention.

Thus, in a first alternative form, the various sections are secured reversibly by their vertical edge to a single element comprising a lateral rod, this single element then forming the lateral edge of the entity.

In other words, in this solution, the various independent sections are all associated with two single lateral rods which have the total length of the display canvas. The operation of replacing a section of notice involves detaching the lateral rods then removing the section in question. A new section is then fitted, then the lateral rods are refitted on the reformed string of notices.

In another embodiment, the various sections comprise, on each vertical edge, a lateral rod. The medium thus comprises means for ensuring the continuity of the various lateral rods of the adjacent sections. In other words, in this solution, the various sections in themselves comprise a lateral rod, and means are provided that allow the ends of the rods to be connected at the facing edges, so as to form a rod that is continuous over the whole of the display canvas. These rods specific to each section may be fixed permanently to the lateral edges of each section, for example by welding.

In other words, in this case, each section incorporates a fraction of the overall lateral rod, the continuity between these various rod fractions being ensured in order to allow the rod to slide correctly in the fixed slideway of the scrollable device.

Various alternative forms of embodiment may be employed to secure the horizontal edges of adjacent sections together.

Thus, in a first variant, the facing horizontal edges of two adjacent sections may be connected via two complementary elements each situated on one of the horizontal edges, these complementary elements collaborating with each other. In other words, in this solution, the top edge of a section has an element that can be hooked onto or more generally collaborate with an element fixed to the bottom edge of the section above. In other words, the adjacent sections are connected directly via their edges.

In another alternative form of embodiment, the facing horizontal edges of two adjacent sections may be connected via a supplementary member collaborating with the two horizontal edges that are to be connected.

In this other solution, the edges of each section do not collaborate directly with one another but each collaborate with the supplementary member which thus acts as the join between these two sections.

In practice, the complementary elements may comprise a number of hooks able to clip into hooks of the complementary element of the adjacent section. These hooks have a profile that requires a small force to fit one edge onto the other, but which on the other hand requires a far greater force to separate adjacent sections.

This solution is particularly well suited to small notice widths, for fitting and dismantling reasons.

In practice, when use is made of a supplementary member to secure the various sections together, the complementary elements and supplementary members comprise a number of hooks, the hooks of each complementary element being able to clip into the hooks of the supplementary member. In other words, the bottom edge of one of the sections clips onto the complementary hooks of part of the intermediate member. The top edge of the section below likewise clips into another part of the intermediate element.

In an alternative form of embodiment regarding the joining-together of the sections, each horizontal edge may have a horizontal rod, the supplementary member then comprising two sideways able to accommodate the horizontal rods of the facing edges. In such a scenario, the rigidity of the connection is provided by the intermediate supplementary member, making it possible to use relatively flexible horizontal rods for the various sections. This solution is then particularly well suited to the use of extensible canvases, which have a very good visual appearance quality.

When each section incorporates a fraction of the overall lateral rod, the device comprises joining elements inserted in the two facing ends of the lateral rods of the adjacent sections. In other words, the continuity of the various individual rods of each section is provided by joining elements that allow the ends of the individual lateral rods to be kept aligned with each other.

In practice, these joining elements may be pushed into a housing pierced parallel to the axis of the rod.

In a preferred form, the lateral rods of the three adjacent sections have a groove opening to the side and intended to accommodate the joining element. In this case, the joining element maybe fitted inside the characteristic groove once the various sections have been joined together via their horizontal edges. This then makes the overall operations of constructing the notice easier.

The joining elements may be in the form of a rigid or semi-rigid peg or alternatively and as a preference may be in the form of a generally U-shaped clip. The central part of the clip provides the connection between the rods of the two adjacent sections. The legs of the clip for their part enter holes provided for that purpose inside the rod, so as to increase the pull-out resistance of the means connecting the sections together.

Advantageously in practice, the display medium according to the invention may comprise at least one locking piece placed astride the facing horizontal edges of the adjacent sections so as to provide a supplementary mechanical connection between said adjacent sections.

Advantageously, this locking piece is installed on just one side of the notice, namely preferably the visible face of the notice on which the operator can work.

BRIEF DESCRIPTION OF THE DRAWING

The way in which the invention can be produced and the advantages that ensue therefrom will become clearly apparent from the description of the embodiments which follow, in support of the attached figures in which.

DETAILED DESCRIPTION OF THE INVENTION

As already mentioned, the invention relates to a display medium intended to be installed in a scrollable device.

Figure 1:
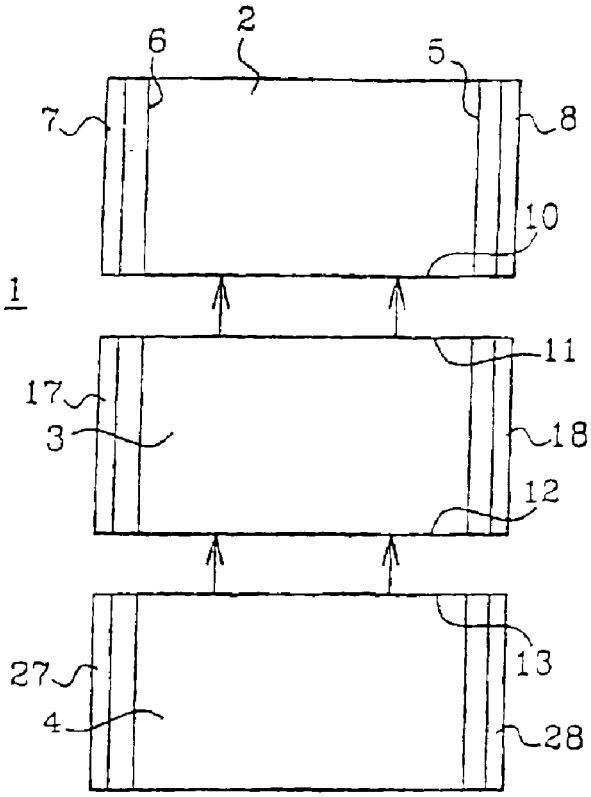
FIG. 1 is an overall view showing the way in which a display medium according to the invention is assembled.

As illustrated in FIG. 1, such a display medium (1) can be produced by reversibly assembling several sections (2, 3, 4) each having an individual notice. In the form illustrated in FIG. 1, each section (2, 3, 4) has, on its lateral edges (5, 6), lateral rods (7, 8) intended to slide in sideways forming part of the scrollable device, not depicted.

Applying a transverse force between the lateral rods (7, 8) allows the notice to be kept under transverse tension, making it easier to wind, and improves its flatness and therefore the visual appearance of the notice.

In the form illustrated in FIG. 1, the various sections (2, 3, 4) are secured together reversibly by their horizontal edges (10, 11, 12, 13).

According to the invention, the display medium (1) comprises means ensuring the continuity of the rods (7, 17, 27; 8, 18, 28) of the various adjacent sections (2, 3, 4). This geometric continuity is necessary to allow optimum sliding in the sideways of the scrollable device.

Figure 2:
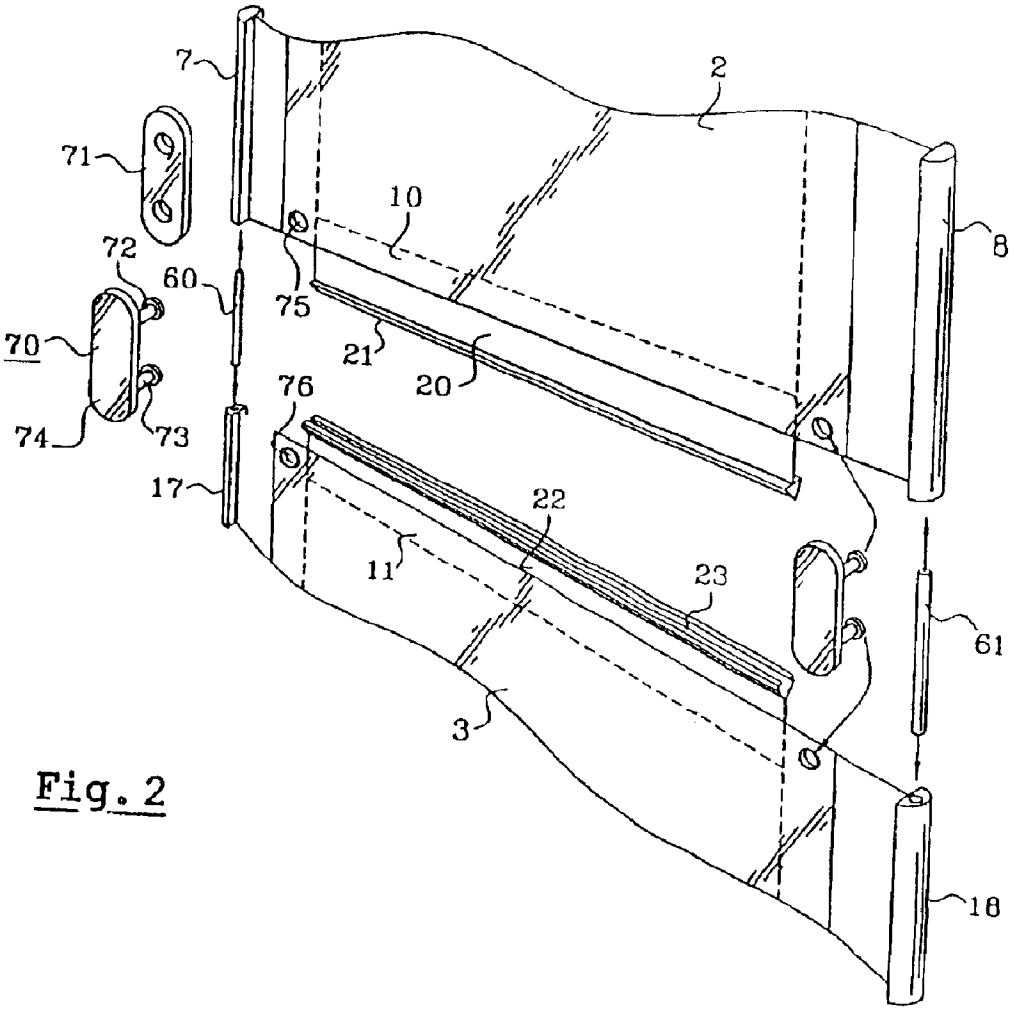
FIG. 2 is a detail brief perspective view of the way in which two adjacent sections are joined together.

FIG. 2 illustrates an exemplary embodiment of the joining-together of the horizontal edges (10, 11) of two adjacent sections (2, 3).

Thus, the bottom edge (10) of the section (2) has a first element (20) which is welded or permanently secured to it by some equivalent means. This element (20) in its bottom part has a thicker region (21). This thicker region (21) can match the shape of a rod or the like and runs across the entire width of the edge (10).

To complement this, the edge (11) of the element (3) has an element (22) also welded or secured to it in a practically permanent manner by any equivalent means. At the top, this element (22) has a groove (23) of a profile that complements the bulged region (21) of the section (2).

Figure 3:
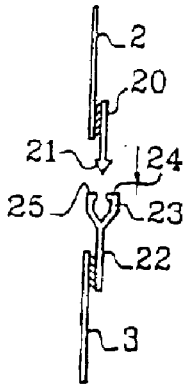
FIG. 3 is the side view illustrating the join between two horizontal edges of two adjacent sections.

One detail of the shape of the complementary elements (21, 23) is illustrated in FIG. 3. Thus, the thicker region (21)

of the element (20) takes on a shape of roughly triangular cross section, with its vertex facing toward the adjacent section (3). The region (23) of the section (3) has a profile that is complementary in terms of cross section. More specifically, this groove (23) has arms (24, 25) that converge toward one another to form a groove of restricted aperture.

The fitting of the element (21) into the groove (23) is performed by slight deformation of the branches (24, 25). Conversely, the triangular shape of the region (21) requires a significant extraction force in order to withdraw it from the groove (23). The two adjacent sections are thus joined together in a way that restricts the risk of the sections separating from one another inadvertently.

Of course, the invention is not restricted to this sole embodiment in which the complementary elements secured to the adjacent sections have a triangular shape and the complementary shape, but also covers other alternative forms in which the collaboration between an element (20, 22) is via a profile of circular cross section or, more generally, any other shape allowing easy fitting and exhibiting good pull-out resistance.

Figure 4:
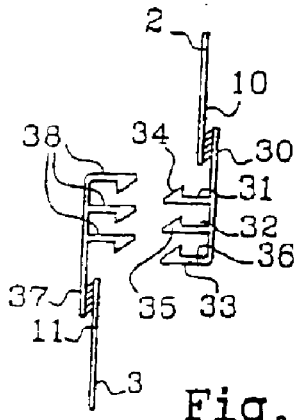
FIGS. 4 to 6 are side views showing alternative forms of embodiment of FIG. 3.
Figure 5:
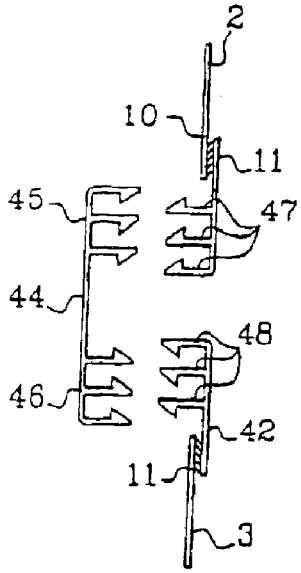
Figure 6:
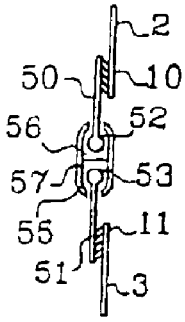

Alternative forms of embodiment of such devices are illustrated for example in FIGS. 4 to 6.

Thus, in FIG. 4, the section has, at its edge (10), an element (30) welded or secured to it by any other equivalent means. At its bottom part this element (30) has a number of hooks (31, 32, 33) directed at right angles to the main plane of the element (30). Each hook (31–33) at its end has a bulged part (34, 35, 36) having a thickness that decreases away from the element (30). These various elements (31, 33) have an overall shape similar to that of a barbed hook.

Symmetrically, the edge (11) of the section (3) is equipped with an element (37) identical to the element (30). The various hooks or barbed hooks (38) are therefore identical to the hooks (31, 33) of the element (30) or complementary. When the edges (10, 11) are brought closer together, the hooks (38) of the element (37) interpenetrate the hooks of the complementary element (30), without the need for significant force, given the shape of the hooks.

When the various bulged parts are slipped one behind the other, the shape of these hooks prevents pulling-out, at least under light load. The two horizontal edges (10, 11) of the sections (2, 3) are thus joined together. Of course, the shape of the hooks and their number per element (30) can be optimized according to the width of the notice. It is not in any way limited to the single embodiment illustrated.

One alternative form of embodiment is illustrated in FIG. 5 in which the edge (10) of the section (2) is equipped with an element (41) analogous to the element (30) in FIG. 4. To complement this, the edge (11) of the section (3) is equipped with an element (42) analogous with the element (41) but having a symmetric configuration with respect to a horizontal plane.

The sections (2) and (3) are joined together via a supplementary member (44) having a region (45) collaborating with the hooks (47) of the element (41). In the same way, the supplementary member (44) comprises a second region (46) intended to collaborate with the hooks (48) of the element (42). The supplementary member (44) is installed in the same way as the elements (30), (38) illustrated in FIG. 4 are combined. By virtue of the use of the supplementary member (44) it is possible to choose more flexible materials from which to make the elements (41, 42) secured to the sections (2, 3). In particular it is possible to choose a material having deformation qualities similar to those of the material used to make the printed canvas.

In this case, when this canvas deforms, the element (41) deforms with it, the latter sliding transversely inside the supplementary member (44). A more rigid material will then be chosen for the supplementary member (44), this additional rigidity giving pull-out resistance.

Another alternative form of embodiment is illustrated in FIG. 6 in which the edges (10) and (11) of the sections (2, 3) are equipped with identical elements (50, 51). These elements (50, 51) at their ends have a rod (52, 53) able to slide inside sideways (56, 57) formed in the supplementary member (55). This supplementary member (55) can be obtained by extrusion in plastic, or alternatively may be formed of a metal section piece. Just as in the example of FIG. 5, this construction allows the element (50, 51) to slide with respect to the supplementary member (55). The extensible nature of the display canvas (2, 3) is therefore put to good use.

With reference to FIG. 2, the continuity of the lateral rod (7, 17; 8, 18) can be obtained by various means, and in particular connecting element pieces (60, 61). These connecting elements may be metal or plastic pegs able to match the curvature of the rod when the latter is wound onto the rollers of the scrollable device, not depicted.

Figure 7:
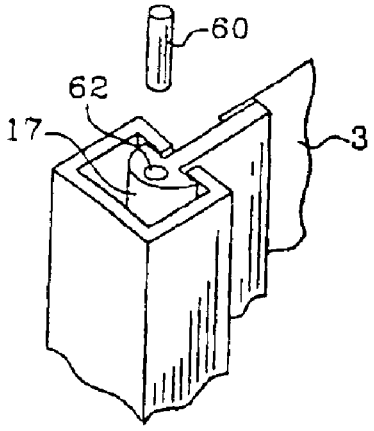
FIG. 7 is a brief perspective view of the way in which the lateral rods of adjacent sections are joined together.

These connecting elements (60, 61) may, as illustrated in FIGS. 2 and 7, be installed inside a housing (62) pierced in the actual thickness of the rod (7, 17; 8, 18). The length of the connecting element (60, 61) and its diameter and material are determined so that they do not generate excessive stresses on the rod (7, 17; 8, 18) upon winding onto the rollers of the scrollable device.

The holes (62) made in the connection (17) are centered precisely so as to obtain optimum continuity of the rods thus joined together.

Figure 8:
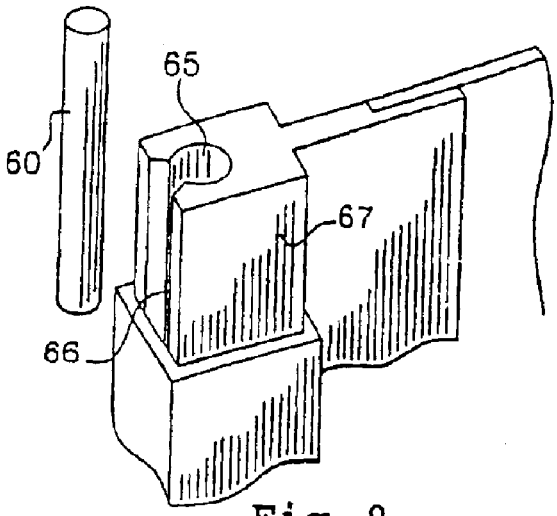
FIGS. 8 and 9 are brief perspective views of alternative forms of embodiment of FIG. 7.

An alternative form of embodiment of this securing is illustrated in FIG. 8 in which the connecting element (60) is fitted transversely into a groove (65) having an opening (66) that opens to the side. The profile of the opening of this groove is determined so as to make it easier to introduce the connecting element (60) laterally without exerting excessive force. This solution has the advantage of first of all allowing the adjacent sections to be joined together by their horizontal edge, and then of allowing the connecting elements (60) to be fitted to ensure the continuity of the lateral rod.

The fitting of the lateral rod (67) inside the slideway, not depicted, prevents any opening up of the opening (66) and therefore any unwanted release of the connecting element (60).

Figure 9:
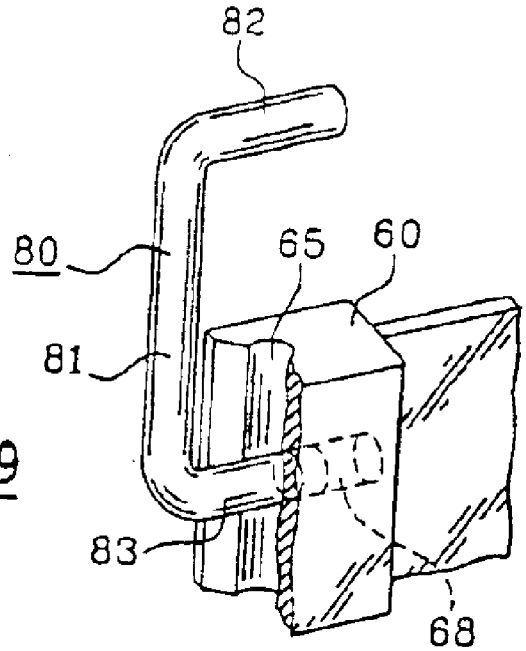

A preferred alternative form of embodiment of the joining-together of the rods is illustrated in FIG. 9. In this case, the connecting element (80) takes on the shape of a clip. This clip (80) has a central part (81) which is housed in the groove (65) of the rod (60). At each end, the clip (80) has a bent-over leg (82, 83), typically at 90°. When the clip (80) is in position, these legs (82, 83) each enter a hole (68) made in the rod, in the bottom of the groove (65). In that way, the clip (80) increases the pull-out resistance of the consecutive sections of notice.

Referring once again to FIG. 2, the joining-together of the various sections (3) may be further improved by the fitting of locking pieces (70, 71). These locking pieces may comprise a first element comprising two dogs (72, 73) mounted on a plate (74). These dogs (72, 73) pass through eyes (75, 76) made on the horizontal edges (11, 12) in the lateral regions. The dogs (72, 73) are then clipped or riveted or secured by any other means to a plate (71) present on the opposite side of the display medium.

These locking pieces (70, 71) may be present on both sides of the display device, or even in a supplementary manner distributed across the width of the display medium.

The locking pieces are advantageously made of a flexible material that can follow the curvature of the display medium when the latter is wound onto the rollers of the scrollable device.

Figure 10:
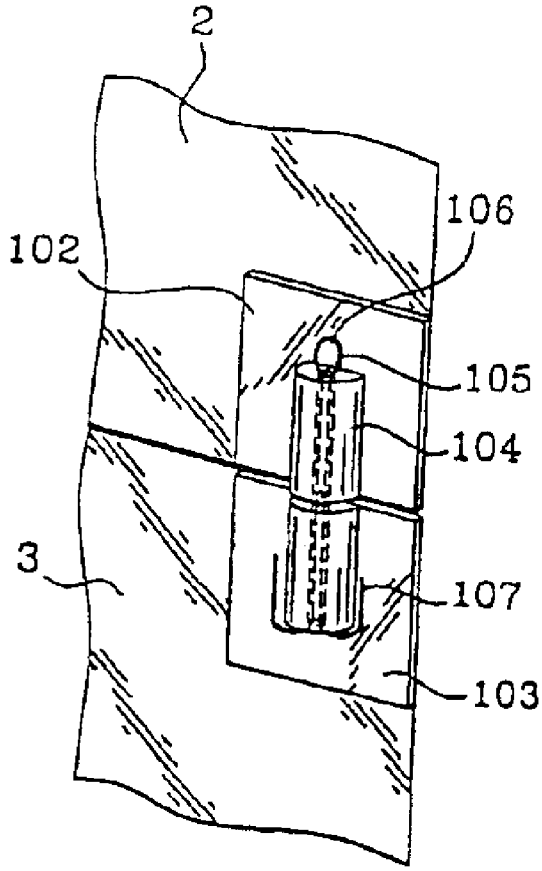
FIG. 10 is a brief perspective view of a detail of the region that forms the join between sections, illustrating an alternative form relating to the locking pieces.

An alternative form of embodiment regarding the locking pieces is illustrated in FIG. 10. In this case, each notice portion (2, 3) has an additional piece (102, 103) secured to the notice by welding, bonding or the equivalent. This additional piece comprises a protruding sleeve (104) pierced with a through-hole (105). The additional pieces (102, 103) are positioned in such a way that their through-holes (105) are aligned with one another. Once the notice sections (2, 3) have been joined together, a pin (106) is introduced into the through-holes (105) of the two additional pieces (102, 103). The tips (107) of the pin (106) are then knocked over to prevent any relative movement of the notice sections (2, 3). Of course, the pin (106) may be replaced by an equivalent means providing a similar connection. This alternative form has the advantage of not requiring access to the opposite side of the notice, thus simplifying installation operations.

Figure 11:
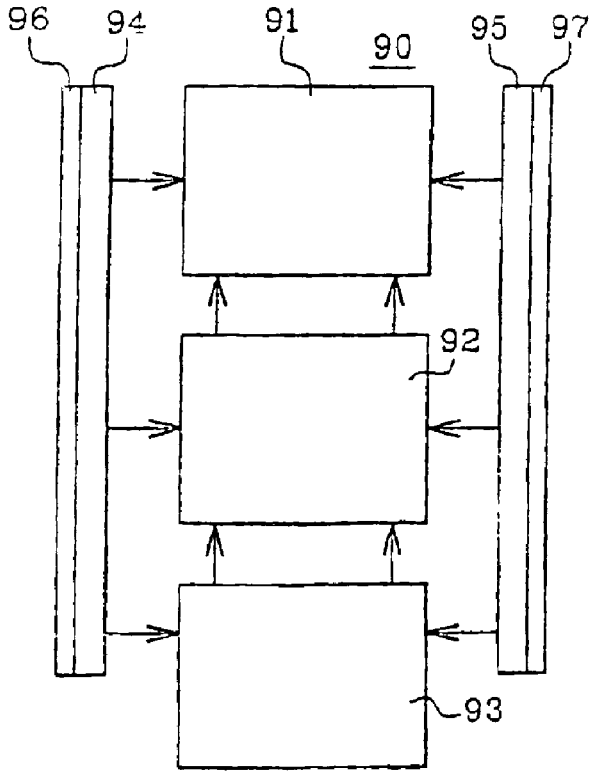
FIG. 11 is a general view illustrating an alternative form of composition of the medium according to the invention, in which the various sections are associated with single lateral rods.

The notice structure illustrated in FIG. 1, in which the various sections (2, 3, 4) each have tractions of the lateral rod (7, 17, 27; 8, 18, 28) may be replaced by the structure illustrated in FIG. 11. In this case, the display medium (90) consists of three sections (91, 92, 93) with no lateral rod. The sections (91, 92, 93) are joined together by their horizontal edges in the same way as the sections (2, 3, 4) described in detail above.

These sections (91, 92, 93) form an entity which then on each of its edges takes a single element (94, 95) comprising a single rod (96, 97) running along the entire length of the display medium. The elements (95, 94) can be secured to the entity formed of the sections (91, 92, 93) in the various ways mentioned earlier as regards the joins between the horizontal edges of the sections.

Of course, the invention is not restricted to the embodiment illustrated in FIGS. 1 and 11 in which the display medium comprises just three sections, but covers all alternative forms regarding the dimensions and number of sections used.

It is evident from the foregoing that the display medium according to the invention has numerous advantages, particularly that of allowing one or several notices to be replaced individually within a collection of notices. This modularity allows different periods to be managed within one and the same scrollable display device.

The notices thus customized can be reused more easily for subsequent campaigns.

I claim:

1. A display medium intended to be installed in a scrollable device, said display medium having a plurality of edges which are guided laterally inside said scrollable device, wherein said display medium comprises a plurality of adjacent sections each having a plurality of horizontal and lateral edges, said adjacent sections being joined together reversibly via facing ones of said horizontal edges thereof, each said adjacent section comprising a lateral rod situated on each said lateral edge thereof and means for ensuring continuity of said lateral rods between said adjacent sections.

2. The display medium claim 1, wherein said facing horizontal edges of two said adjacent sections are connected via two complementary elements each situated on one of said horizontal edges of said two adjacent sections and collaborating with each other.

3. The display medium of claim 2, wherein each said complementary element comprises a plurality of hooks adapted to clip into corresponding hooks provided on said complementary element of said adjacent sections.

4. The display medium of claim 1, wherein said facing horizontal edges of two said adjacent sections are connected via a supplementary member collaborating with said facing horizontal edges of said two adjacent sections that are to be connected.

5. The display medium of claim 4, wherein said facing horizontal edges of two said adjacent sections are connected via two complementary elements each situated on one of said horizontal edges of said two adjacent sections, and via said supplementary member, wherein said complementary element and said supplementary member each comprise a plurality of hooks, and wherein said hooks of each said complementary element are adapted to clip into said hooks of said supplementary member.

6. The display medium of claim 4, wherein each said facing horizontal edge of said two adjacent sections includes a horizontal rod and wherein said supplementary member comprises two sideways adapted to accommodate said horizontal rods.

7. The display medium of claim 1, further comprising a joining element inserted in each of a facing end of each said lateral rod of said adjacent sections.

8. The display medium of claim 7, wherein said lateral rods of said adjacent sections include a groove opening to a side thereof to accommodate said joining element.

9. The display medium of claim 7, wherein said joining elements each have a shape of a clip having bent-over ends which enter holes provided for that purpose in said facing ends of said adjacent lateral to increase the pull-out resistance of said display medium.

10. The display medium of claim 1, further comprising at least one locking piece positioned astride facing ones of said horizontal edges of said adjacent sections to provide a supplemental mechanical connection between said adjacent sections.

11. The display medium of claim 10, wherein said locking piece is installed only on one side of said display medium.

* * * * *